US005677022A

United States Patent [19]

Zeman et al.

[11] Patent Number: 5,677,022

[45] Date of Patent: Oct. 14, 1997

[54] ELECTROSTATOGRAPHIC ROLLER MASK

[75] Inventors: Robert Edward Zeman, Webster; David Richard Jackson, Rochester; William Bernard Vreeland, II, Webster, all of N.Y.

[73] Assignee: Eastman Kodak Company, Rochester, N.Y.

[21] Appl. No.: 761,060

[22] Filed: Dec. 5, 1996

Related U.S. Application Data

[63] Continuation of Ser. No. 338,923, Nov. 14, 1994, abandoned.

[51] Int. Cl.[6] ..... B05C 17/02; G03G 15/12

[52] U.S. Cl. ..... 428/34.1; 160/238

[58] Field of Search ..... 428/34.1; 160/238

[56] References Cited

U.S. PATENT DOCUMENTS

| | | | |
|---|---|---|---|
| 2,807,233 | 9/1957 | Fitch | 118/637 |
| 3,010,153 | 11/1961 | Bittner | 264/311 |
| 3,200,180 | 8/1965 | Russ et al. | 264/311 |
| 3,520,604 | 7/1970 | Shelffo | 355/16 |
| 3,697,171 | 10/1972 | Sullivan | 355/17 |
| 3,702,482 | 11/1972 | Dolcimascolo et al. | 346/74 |
| 3,781,105 | 12/1973 | Meagher | 355/3.96 |
| 3,893,761 | 7/1975 | Buchan et al. | 355/3 R |
| 3,923,392 | 12/1975 | Bachan et al. | 355/3 R |
| 3,959,574 | 5/1976 | Seanor et al. | 428/425 |
| 4,031,600 | 6/1977 | Whigham | 492/48 |
| 4,050,886 | 9/1977 | Moser | 355/290 |
| 4,068,937 | 1/1978 | Williemse et al. | 355/3 TR |
| 4,257,699 | 3/1981 | Lentz | 355/3 FU |
| 4,264,181 | 4/1981 | Lentz et al. | 355/3 FU |
| 4,394,340 | 7/1983 | Tarumi et al. | 264/311 |
| 4,430,406 | 2/1984 | Newkirk et al. | 430/99 |
| 4,453,820 | 6/1984 | Suzuki | 355/3 TR |
| 4,455,079 | 6/1984 | Miwa et al. | 355/3 TR |
| 4,517,138 | 5/1985 | Rawlings et al. | 264/311 |
| 4,729,925 | 3/1988 | Chen et al. | 428/425.8 |
| 4,742,941 | 5/1988 | Tastet | 222/309 |
| 4,810,564 | 3/1989 | Takahashi et al. | 428/213 |
| 4,853,737 | 8/1989 | Hartley et al. | 355/289 |
| 4,859,396 | 8/1989 | Krenkel et al. | 264/311 |
| 4,889,674 | 12/1989 | Krenkel et al. | 264/311 |
| 4,910,559 | 3/1990 | Kuge et al. | 355/285 |
| 5,011,739 | 4/1991 | Nielsen et al. | 428/425.8 |
| 5,035,950 | 7/1991 | Del Rosario | 428/421 |
| 5,084,735 | 1/1992 | Rimai et al. | 355/271 |
| 5,156,915 | 10/1992 | Wilson et al. | 428/425.8 |
| 5,187,526 | 2/1993 | Zaretsky | 355/273 |
| 5,200,284 | 4/1993 | Chen et al. | 430/33 |
| 5,212,032 | 5/1993 | Wilson et al. | 430/65 |
| 5,215,852 | 6/1993 | Kato et al. | 430/126 |
| 5,217,838 | 6/1993 | Wilson et al. | 430/126 |
| 5,250,357 | 10/1993 | Wilson et al. | 428/425.8 |
| 5,259,989 | 11/1993 | Schlueter, Jr. et al. | 252/500 |
| 5,259,990 | 11/1993 | Schlueter, Jr. et al. | 252/500 |
| 5,266,431 | 11/1993 | Mammino et al. | 430/96 |
| 5,383,834 | 1/1995 | Kanome et al. | 492/25 |
| 5,536,352 | 7/1996 | Zeman et al. | 156/242 |

FOREIGN PATENT DOCUMENTS 6-202811 9/1986 Japan .

*Primary Examiner*—Kriellion S. Morgan

[57] ABSTRACT

This invention provides a roller mask for use as part of a transfer roller in an electrostatographic machine consisting of a dimensionally stable base, polymeric material adhered to the base, and means for mounting the base onto a roller core.

15 Claims, 2 Drawing Sheets

FIG. 2
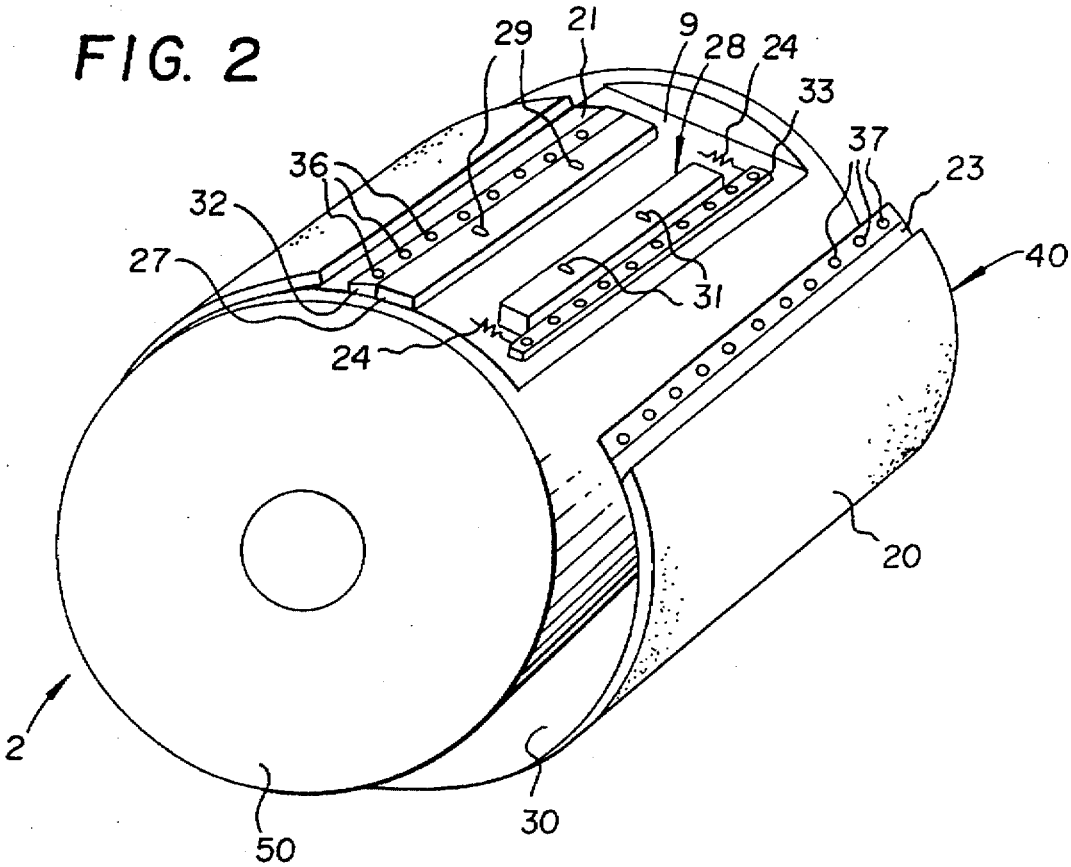
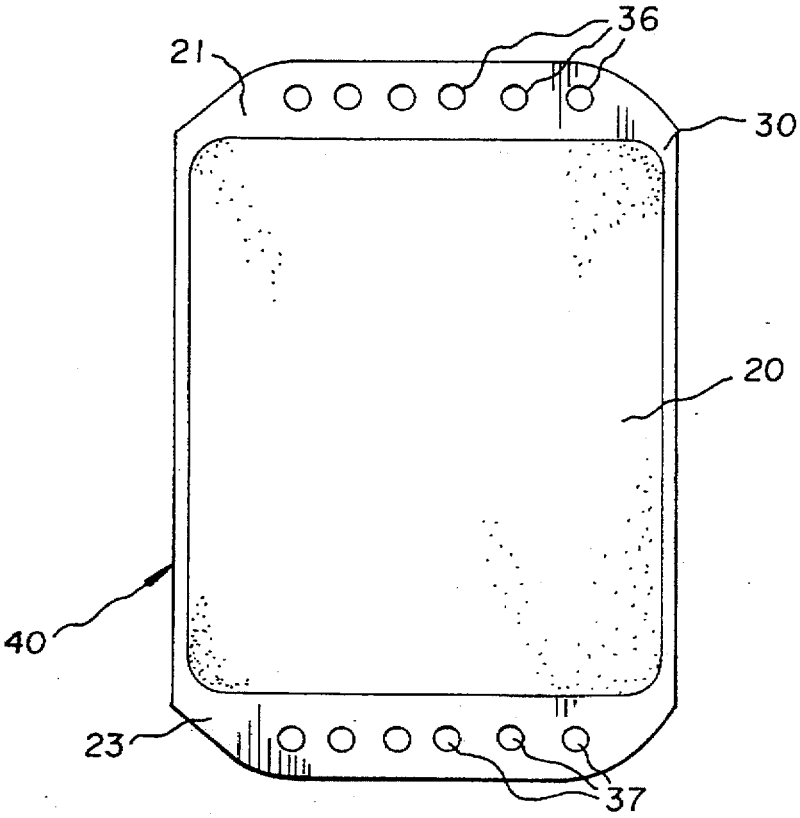
FIG. 3

ELECTROSTATOGRAPHIC ROLLER MASK

This is a Continuation of U.S. application Ser. No. 08/338,923, filed 14 Nov. 1994 now abandoned.

FIELD OF THE INVENTION

This invention relates to rollers in electrostatographic machines. Specifically, this invention relates to polymer coated rollers in electrostatographic machines.

BACKGROUND OF THE INVENTION

In electrostatography an image comprising a pattern of electrostatic potential (also referred to as an electrostatic latent image) is formed on an insulative surface by any of various methods. For example, the electrostatic latent image may be formed electrophotographically (i.e., by imagewise radiation-induced discharge of a uniform potential previously formed on a surface of an electrophotographic element comprising at least a photoconductive layer and an electrically conductive substrate), or it may be formed by dielectric recording (i.e., by direct electrical formation of a pattern of electrostatic potential on a surface of a dielectric material). Typically, the electrostatic latent image is then developed into a toner image by contacting the latent image with an electrographic developer. The toner image can be transferred from the element to a receiver such as paper, or to an intermediate transfer member.

The intermediate transfer member is commonly used for a number of reasons in electrophotography including simplified receiving sheet handling, doing single pass duplexing, saving wear on photoconductors and superposition of images, e.g., to form multi-color images. Typically, the toner image on a photoconductive element is transferred by conventional, electrical field assisted transfer to the intermediate roller. For example, a negatively charged toner image is transferred from a photoconductor having a grounded backing electrode to an intermediate belt or roller biased to a strong positive polarity. The toner image is then transferred from the intermediate belt or roller to a receiving sheet under the influence of a second electric field which can be created without changing the field on the intermediate member by placing a roller (or corona) behind the receiving sheet biased to a stronger positive potential.

Although other reasons mentioned above for using intermediate transfer are still valid, it appears the most desirable use of it in the future may be for creating multi-color images. When an intermediate transfer member is used, two, three, or four separate images of different color can be transferred in registration to the intermediate member to create a multi-color image and then the multi-color image can be transferred in one step to the receiving sheet. This system has a number of advantages over the more conventional approach to making multi-color images in which the receiving sheet is secured to the periphery of a roller and rotated repeatedly into transfer relation with the photoconductor to receive the color images directly. Probably the most important advantage is that the receiving sheet itself does not have to be attached to a roller which is a source of misregistration of images and adds to the complexity of the apparatus. Other advantages of the intermediate transfer roller include decreased wear and tear on the photoconductive member and the benefit of a straight and simple receiving sheet path.

Many transfer materials have been suggested for the toner receiving layer of the intermediate transfer systems. The most common are relatively soft materials, such as silicone rubber, polyurethane, or fluoroelastomers; see, for example, U.S. Pat. Nos. 3,893,761; 4,453,820; 3,923,392; 4,455,079; 3,697,171; 5,011,739; and 5,250,357.

Commonly, the intermediate transfer roller is constructed of a metal core onto which the above-listed polymers are compression molded and then ground to achieve a closer approximation to a cylinder. There are mechanical deficiencies associated with this approach, in that the compression molding about the core leads to non-uniform thickness (and thus a non-uniform electric field) and the grinding imparts a surface roughness, which has been observed as a visual pattern in the transferred toner image. For very high image quality, an intermediate member having very uniform thickness and very smooth surface texture is desired.

SUMMARY OF THE INVENTION

The invention provides a mask for use as part of a roller in an electrostatographic machine, the mask comprises: a critically dimensionally stable base; polymeric material adhered to the base; and means for mounting the base onto the roller core.

This invention provides an advantage in that the mask can be removably mounted onto the core; therefore, the mask can be replaced when the polymeric material adhered to the base becomes worn or damaged which is cheaper than replacing the entire roller. Additionally, the mask can be prepared by methods which produce a very smooth and uniform surface which avoids an additional grinding step. These methods include compression-molding onto a flat surface, sheet-extrusion, spray-coating, ring-coating, colandering and centrifugal casting. The preferred method is centrifugal casting which involves the steps of: inserting a critically dimensionally stable base into a centrifugal apparatus; adding polymeric material to said centrifugal apparatus; centrifuging the polymeric material until the polymeric material is cast to the base to produce a mask; and removing the mask from the centrifugal apparatus.

The mask provides a surface of uniform thickness that does not require grinding. The uniform surface provides a uniform charge resulting in uniform transfer of the toner particles. This is particularly important when smaller toner particles are used.

BRIEF DESCRIPTION OF THE DRAWINGS

FIG. 2 is a perspective view showing a transfer roller core having a mask partially mounted onto it.

FIG. 3 is a flat view of a mask.

DESCRIPTION OF THE INVENTION

Figure 1:
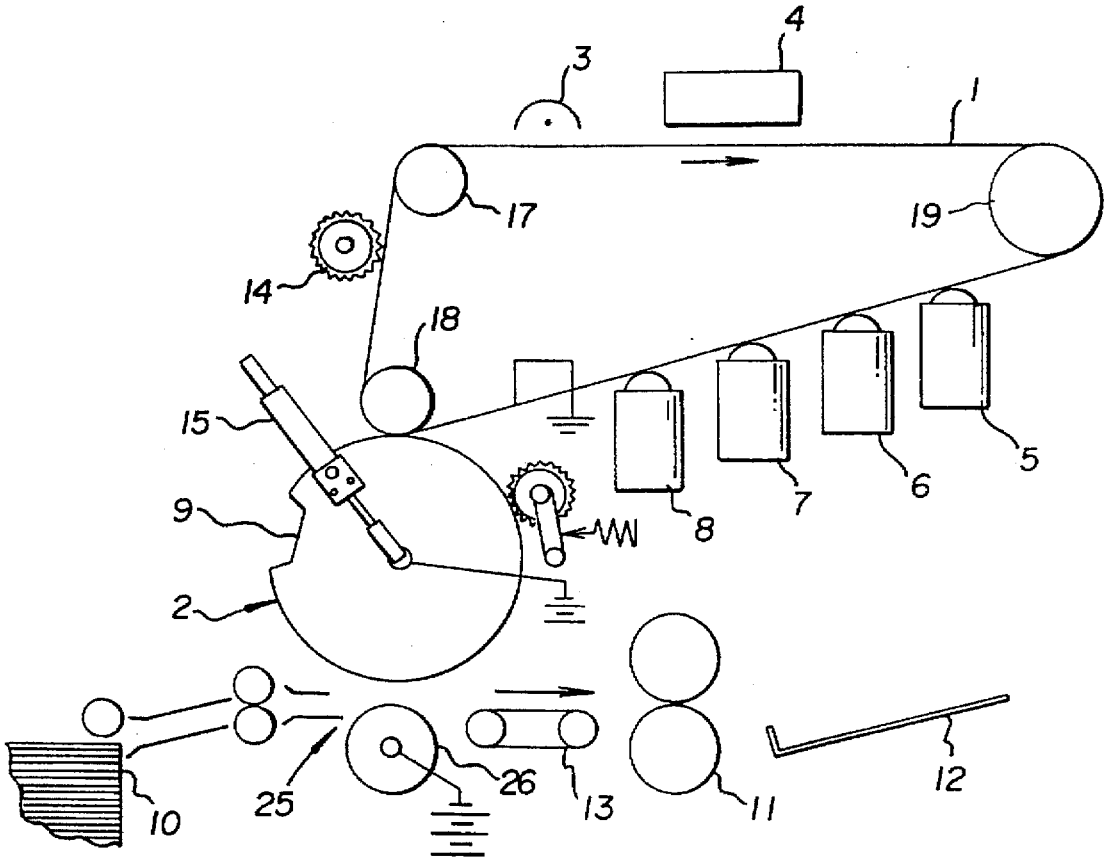
FIG. 1 is a side schematic view of a color electrostatographic apparatus using a mask on an intermediate transfer roller.

The invention provides a mask for use as part of a roller in an electrostatographic machine, the mask comprises: a critically dimensionally stable base; polymeric material adhered to the base; and means for mounting the base to the roller core.

The term "roller" is used herein to mean a part of an electrostatographic machine minimally consisting of a core and the mounted mask. Although the particular embodiment described below is the use of a mask as part of an intermediate transfer roller, the mask is not limited to use on an intermediate transfer roller only and can be used on any roller in an electrostatographic machine including a fuser roller, pressure roller, or photoconductive drum.

The base material for the mask can be any material which provides a critically dimensionally stable base which can be mounted onto the core. The term "critically dimensionally stable" as used to describe the base material means that the material possesses a Youngs Modulus greater than 0.27 MPa, more preferably it possesses a Youngs Modulus greater than $4.8\times10^4$ MPa, and most preferably it possesses a Youngs Modulus greater than $6.9\times10^4$ MPa. It is preferred that the base material be substantially incompressible, and that the base material possesses a thermal coefficient of expansion at 100° C. less than 200 μm/m°C., more preferably a thermal coefficient expansion at 100° C. less than 12 μm/m°C.

The base material can be metallic, polymeric, polymeric-metallic, ceramic, glass, fiberglass, or natural and artificial fabrics or mixtures of these materials. Examples of polymers which can be used as the base material include polyimides, such as Kapton™ available from E. I. dupont de Nemours and Co., polyarylsulfones, polyamideimides, high temperature nylons, and certain aromatic copolyesters such as Estar™, available from Eastman Kodak Co., and Ekkcel™ available from Carborundum. The base can consist of a metal such as aluminum, anodized aluminum, steel, stainless steel and nickel. Generally, the thickness of the base is preferably between 0.0005 inch and 0.250 inch. The preferred base material for the mask is metal. For a metal base, the thickness of the base is preferably between 0.005 and 0.250 inch. It is preferred that the base material has a surface roughness of greater than 1 μinch and less than 500 μinches, more preferably greater than 100 μinches and less than 250 μinches to improve adhesion between the base and the polymeric materials.

The base can take various shapes, for example, rectangular, square, trapazoidal, or cylindrical, as long as the mask covers the toner or charge receiving surface of the roller of which it is a part. The preferred shape of the base is substantially rectangular having a length and width approximately equivalent to the length and the circumference, respectively, of the core onto which the base is mounted. However, the actual dimensions of the base will also depend upon the means for mounting the mask onto the core. Because the base must wrap around the core, it is preferred that the base be made out of a flexible material. The most preferred base is a flexible rectangular sheet of anodized aluminum.

The polymeric material can be adhered either directly or indirectly to the base. It can be indirectly adhered to the base by corona charging the base or mechanical attachments to the base; however, it is preferred that the polymeric material be adhered directly to the base. The adhesion between the base and the polymeric material must be sufficiently strong so that the polymeric material will not delaminate from the base when the roller mask is used in an electrostatographic machine. The polymeric material must be compliant and flexible enough to withstand any bending the mask may be required to do in order to be mounted onto the roller core. It is preferred that the polymeric material possesses a Youngs Modulus greater than 0.3 MPa, more preferably a Youngs Modulus greater than 1 MPa, and most preferably a Youngs Modulus greater than 2 MPa. Additionally, it is preferred that the polymeric material have a useful life of at least 10,000 copies.

The polymeric material can consist of a single polymeric material; layers of polymeric materials and layers of non-polymeric materials; or a mixture of polymeric materials or polymeric materials and non-polymeric materials in a single layer or multiple layers. The term polymeric materials includes monomeric materials that are useful in forming surface layers of rollers. The polymeric materials that can be used on the base include silicones, such as polymethylsiloxanes and polymethylphenylsiloxanes; fluoroelastomers, such as copolymers of vinylidene-hexafluoropropylene and vinylidene-hexafluoropropylenetetrafluoroethylene; fluoropolymer resins, such as polytetrafluoroethylene, polyfluorinated ethylenepropylene and perfluoroalkoxyhexafluoropropylene; and polyurethanes. Examples of useful polymeric materials include those disclosed in U.S. Pat. Nos. 2,807,233; 3,520,604; 3,702,482; 3,781,105; 3,959,574; 4,257,699; 4,264,181; 4,430,406; 4,729,925; 4,742,941; 4,810,564; 4,853,737; 4,910,559; 5,035,950; 5,166,031; and 5,200,284, which are incorporated herein by reference.

The polymeric materials can be non-crosslinked, crosslinked or interpenetrating networks or mixtures of one or more of those polymer networks. The polymeric materials can contain fillers, crosslinkers, antistats, pigments, plasticizers, or conductivity agents, antiozonants, fungicides, dyes, reactive dyes and moisture scavengers. Useful materials for these purposes are well known to a person of ordinary skill in the art. Additional information on useful polymeric materials can be found in U.S. patent Ser. No. 122,754, filed Sep. 16, 1993; U.S. patent Ser. No. 940,582, filed Sep. 4, 1992; and U.S. patent Ser. No. 164,280, filed Dec. 9, 1993, incorporated herein by reference.

Non-polymeric materials which can be added to the polymeric material or coated as an additional layer between polymeric material layers include metallic fillers and metals, and other inorganic materials such as glass and silica. The metal layers can be coated from metal solutions or dispersions. Metal layers or other conducting layers may be required to provide the proper amount of conductivity to the roller depending on the final application of the mask. For example, if a non-conductive base is used when forming an intermediate transfer roller mask, a conducting layer, which is preferably a metal or metal-containing layer, should be incorporated between the non-conductive base and the polymeric material. In an example of a particular embodiment of the invention, to form a conductive layer a polymeric material consists of approximately 8 percent by weight of the filler on a 100 percent total solids weight basis.

Often the polymeric material includes a primer adhesive or conductive adhesive layer which is applied to a critically dimensionally stable base prior to the application and adhesion of additional polymer layer or layers. The primer or adhesive may vary depending upon the polymeric material to be applied to the base. Examples of primers include silane coupling agents, such as Conap™ AD-1147, polyamides, polyimides, polyamideimides, epoxy resins, benzoguanamineformaldehyde resin crosslinker, epoxy cresol novolac, dianilinosulfone crosslinker, and polyphenylene sulfide polyether sulfone.

The polymeric material consisting of one or more layers preferably has a final thickness between 0.01 and 3.0 inches and provides a surface roughness of 1 μinch to 100 μinches.

When the roller mask is used as an intermediate transfer member, the preferred materials for the polymer layer or multi-layers of the roller mask are thermoset or thermoplastic polyurethanes. Examples of thermoset polyurethanes include Conathane™ TU-400 and Conathane™ TU-500 both available from Conap, Inc. Examples of thermoplastic polyurethanes include Permuthane™ U6729 and Permuthane™ U10086 available from Stahl Finish. Examples of useful polyurethane coatings are disclosed in U.S. Pat. Nos. 3,959,574; 5,011,739; 5,156,915; 5,212,032; 5,217,838;

5,259,989; and 5,259,990, which are incorporated herein by reference. The polyurethanes may contain any of the additional addenda which were desired earlier. Preferably antistats are incorporated into the polyurethanes to give a volume resistivity of from $1\times10^5$ to $1\times10^{13}$ ohms-cm; preferably from $1\times10^7$ to $1\times10^{11}$ ohms-cm. Examples of antistats include quaternary ammonium salts and phosphonium salts. Particular examples of useful antistats are disclosed in U.S. Pat. Nos. 5,212,032; 4,729,925; and 4,742,941, which are incorporated herein by reference.

The preferred roller mask is mounted onto a core and used for an intermediate transfer roller. This preferred roller mask consists of an anodized aluminum base and multi-layers of polymeric material. The first layer on the metal base is a primer layer. The primer layer is a silane coupling agent such as Conap™ AD-1147 supplied by Conap, Inc. The next layer is a polyurethane layer consisting of polyether-based polyurethane, and the top layer is a polyester-based polyurethane overcoat layer. The overcoat layer preferably differs from the middle polyurethane layer by having a higher Youngs Modulus than the undercoat layer. The overcoat layer preferably has a final thickness of 0.5 to 75 microns. The polymer layers of the roller mask preferably have a total final thickness of 0.01 to 5 inches, preferably 0.01 to 1 inch, most preferably 0.05 to 0.5 inches.

The mask is mounted onto a core for use in an electrostatographic machine. The means for attaching or mounting the mask onto the core can consist of hooks, latches, clamps, clasps, grips or the like or combinations of the above on the core or mask which fit into holes, indentations, slots, receivers or the like or combinations of the above on the mask or core, respectively. Alternatively, the core and/or the mask can have holes, which can be threaded to receive screws or bolts. The mask can also be attached or mounted onto the core with adhesives. Additionally, the base of the mask can be grooved on the side that does not have any polymer coating on it and the core can be grooved so that the two sets of grooves fit or slide into each other. The base of the mask can be made with clasps or holes on the base's ends and/or edges that can be locked into each other or tied together when the mask is mounted onto the core. The circumferencial ends of the core can have clamps, braces, or separate rims that receive the mask or fit over the circumferencial ends of the mask to hold the mask to the core.

One preferred method of mounting the mask to the core is to provide holes in two opposite edges of the mask and a gully in the core having hooks on one side which fit into the holes in one edge of the mask, and latches on the second side of the gully which fit through the holes in the other edge of the mask and pull the mask taut when closed. The gully can be made narrow enough so that only the edges of the mask fit into the gully thereby providing a continuous or almost continuous polymeric surface to a roller. Alternatively, the gully can be broader than the thickness of the edges of the mask. When the gully is broader than the thickness of the edges of the mask inserted into it, the roller is preferably cantilevered from and into contact with toner images.

Another preferred embodiment of mounting the mask onto the core is to provide holes in two opposite edges of the mask and threaded holes in both sides of a gully in the core. When the mask is wrapped around the core the holes in the edges of the mask line up with the threaded holes in the gully. A plate having holes which are also in line with the holes of the gully and mask is placed over each edge of the mask and bolts are screwed into the core holding the plate and mask to the core.

A third preferred embodiment is shown in FIG. 2 which is described below.

The core is a single element. It is preferably metal consisting of, for example, aluminum, anodized aluminum, steel, stainless steel, nickel or copper. The core can also consist of a polymer like a hard polycarbonate or nylon. The core can be made by any method known in the art. One method to form a core with the gully is to extrude a standard metal core, grind it to the proper outside diameter, and tangentially cut the core to form the space for the gully. If the core has a small wall thickness, it may be preferable to weld a metal liner onto the core to form the gully. The core preferably has a higher Youngs Modulus, a lower thermal coefficient of expansion and less compressibility than the base. The core can be removably inserted into the electrostatographic machine usually by way of a centering shaft which is mounted into bearings.

The mask can be made by any method known in the art for coating layers of materials onto a base. The preferred methods of making the mask are by methods which provide a very smooth coating of uniform thickness without requiring that additional mechanical steps such as grinding be performed. Because the base is preferably a sheet that can be laid out flat while the layer or layers containing polymeric material are applied to it, the polymeric material can be applied to the base in many ways which cannot be used to apply a uniform polymeric material directly to a roller core without requiring additional grinding steps. The mask can be made by compression-molding, sheet-extrusion, centrifugal casting, spray-coating, ring-coating, injection-molding and others known to a person of ordinary skill in the art or a combination of these or other methods. A smooth coating is one which has a surface finish of less than 100 μinches; more preferably less than 25 μinches; most preferably less than 10 μinches.

When the base is cylindrical any of the methods described above can be used to apply the polymeric material to the base; however, additional grinding steps may be necessary. If grinding steps are necessary, the mask still provides the benefit that it can be removably mounted onto the core, which makes it possible to replace only the mask when the polymeric material is damaged or worn.

The preferred method of preparing the roller mask is by centrifugal casting of the polymeric material onto a base. This method consists of thoroughly cleaning the appropriately sized base, and optionally applying an appropriate primer. Next the base is placed into a centrifugal apparatus so that it lines the outer wall of the cylindrical cavity or drum of centrifugal apparatus with the primed surface, if any, of the base facing inward. The polymeric material is prepared and added to the centrifugal apparatus and the polymeric material is centrifuged until the polymeric material is cast onto the base. The preparation, adding and centrifuging steps are repeated for each individual layer when multi-layers are cast onto the base. After casting is complete, the mask is removed from the centrifugal apparatus. If the base is a cylinder made of flexible material, it can be turned inside out to form the mask. If the base is not flexible or is rectangular, the mask is usually cut down a seam to form a mask which is rectangular.

The term "cast" is used herein to describe the polymeric material after it has been hardened enough around the periphery of the cylindrical cavity of the centrifugal apparatus so that it will not permanently deform upon removal from the centrifugal apparatus. The term "cast" is also used as a verb to mean the act of hardening of the casted polymeric material while it is centrifuged. During the centrifuging step, the polymeric material is usually in liquid form or is a powder dispersed in a solvent. During the centrifuging step, the liquid polymeric material hardens into cast polymeric material as the result of, for example, crosslinking reactions, solvent evaporation, catalytic reactions or high temperature cure. Typically, the cast polymeric material is adhered to the base as a result of the casting process; however, if desired mechanical means can also be used to attach the cast polymeric material to the base. Depending upon the type of polymeric material, further steps may need to be taken to complete the hardening process after removing the cast polymeric material from the centrifugal apparatus. Further hardening may require, for example, high temperature cure in an oven, evaporation of solvent, or a crosslinking reaction. Additional information on making a centrifugal cast roller mask is found in U.S. Pat. No. 5,536,352, entitled "Methods of Making Centrifugally Cast Parts," filed herewith and incorporated herein by reference.

The mask can be mounted onto any roller core in an electrostatographic machine to preferably provide the benefits of uniform layer, uniform charge, smooth surface, and replaceability. The presently preferred use for the mask is removably mounted onto the intermediate transfer roller core.

FIG. 1 illustrates an electrostatographic apparatus in which the invention can be used. A primary image member, for example, a photoconductive element 1 is trained about rollers 17, 18 and 19, one of which is drivable to move image member 1 past a series of stations well known in the electrostatographic art. Primary image member 1 is uniformly charged at a charging station 3, image-wise exposed at an exposure station 4, e.g., an LED print head or laser electronic exposure station, to create an electrostatic image. The image is toned by one of toner stations 5, 6, 7 or 8 to create a toner image corresponding to the color of toner in the station used. The toner image is transferred from primary image member 1 to an intermediate transfer roller or drum 2 at a transfer station formed between roller 18, primary image member 1, and intermediate transfer roller 2. The primary image member 1 is cleaned at a cleaning station 14 and reused to form more toner images of different color utilizing toner stations 5, 6, 7, and 8. One or more additional images are transferred in registration with the first image transferred to intermediate transfer roller 2 to create a multi-color toner image on the surface of intermediate transfer roller 2.

The intermediate transfer roller 2 is shown with a gully 9, which is where the edges of the roller mask are mounted onto the core of the intermediate transfer roller 2. Piston 15 moves the intermediate transfer roller 2 into and out of contact with primary image member 1 and into and out of contact with backing roller 26. The intermediate transfer roller 2 contacts and rotates with the primary image member 1 when toner is transferred from the primary image member 1 to the intermediate transfer roller 2. After the transfer of toner, the intermediate transfer roller 2 is moved from contact with the primary image member 1 by piston 15 and cantilevered into position so that the next toner image will be aligned with the first. This process is repeated for each color toner image.

After all the color toner images have been transferred to the intermediate transfer roller 2 from the primary image member 1, piston 15 moves the intermediate transfer roller 2 into contact with a receiving sheet fed from supply 10 and a backing roller 26 at transfer station 25. The transfer of the multi-color image on the intermediate transfer roller 2 to the receiving sheet occurs at transfer station 25. The receiving sheet is then moved from transfer station 25 by a transport mechanism 13 to a fuser 11 where the toner image is fixed by conventional means. The receiving sheet is conveyed from the fuser 11 to an output tray 12.

The toner image is transferred from the primary image member 1 to the intermediate transfer roller 2 in response to an electric field applied between the core of roller 2 and a conductive electrode forming a part of primary image member 1. The multi-color toner image is transferred to the receiving sheet at transfer station 25 in response to an electric field created between a backing roller 26 and the intermediate transfer roller 2. Thus, intermediate transfer roller 2 helps establish both electric fields. As is known in the art, the coating on the intermediate transfer roller 2 usually contains an appropriate amount of anti-static material for this purpose. Typically, an electrode buried in primary image member 1 is grounded for convenience in cooperating with the other stations in forming the electrostatic and toner images. If the toner is a positively-charged toner, an electrical bias applied to intermediate transfer roller 2 of typically −100 to −1,000 volts will effect substantial transfer of toner images to transfer roller 2. To then transfer the toner image onto a receiving sheet at transfer station 25, a bias, e.g., of −2,000 volts, is applied to backing roller 26 to again urge the positively charged toner to transfer to the receiving sheet. Schemes are also known in the art for changing the bias on roller 2 between the two transfer locations so that backing roller 26 need not be at such a high potential.

FIG. 2 is a perspective view showing a preferred embodiment of the intermediate transfer roller 2 having a roller mask 40. The intermediate transfer roller 2 has a core 50, a gully 9, and the roller mask 40. The roller mask 40 consists of a base 30 and an attached polymeric material 20. The roller mask 40 is shown mounted onto the core at the first edge 21 of the base 30 and not attached at the second edge 23 of the base 30. The base 30 has holes 36 and 37 along the first and second edges 21 and 23, respectively. The roller mask 40 is mounted onto the core 50 via clamping mechanisms 27 and 28. Clamping mechanism 27 consists of bracket holddown slots 29, and a strip of holes 32. The clamping mechanism 27 is attached to the roller mask 40 via bolts (not shown) through the holes in the strip of holes 32 and the holes 36 in the base 30. The clamping mechanism 27 is attached to the core 50 via bolts (not shown) which are screwed into the core 50 through the bracket holddown slots 29. The bracket holddown slots are in a slidable relationship with the bolts. The clamping mechanism 28 has the same features as the clamping mechanism 27 except it has additional springs 24 which are attached to the clamping mechanism 28 and to the core 50. The clamping mechanism 28 has bracket holddown slots 31 and a strip of holes 33. The clamping mechanism 28 is not shown attached to the roller mask 40, but it can be attached via screws (not shown) through holes 37 in the base 30 and the holes in the strip of holes 33. The number of holes 36, 37 and the number of holes in the strips of holes 32 and 33 can be varied for a particular use. The springs 24 hold the roller mask 40 taut, because bracket holddown slots 31 are in a slidable relationship with the bolts (not shown) which are screwed through the bracket holddown slots 31 and into the core 50.

FIG. 3 shows a flat, front view of a roller mask 40 when it is not mounted onto a core. The roller mask consists of a base 30 with an attached polymeric material 20, and holes 36 and 37 through the edges 21 and 23 repectively of the base 30.

The following example illustrates the invention:

EXAMPLE

Preparation of an Intermediate Transfer Roller Having a Roller Mask

Preparation of An Aluminum Base:

A 0.01 inch thick and 13.25 inch wide aluminum sheet anodized on one side was cut to a length of 20 inches. The anodized aluminum was cleaned with acetone and the first 1 inch of two opposite edges was treated with a silicone release agent, Conap™ MR 5002. The remaining anodized portion was treated with a solution of 10 grams polyurethane primer, Conap™ AD 11457, and 20 grams toluene/isopropanol (1:1). The Conap™ products were supplied by Conap, Inc. The primer was applied with a lint free cloth and was dried at room temperature for one hour. The metal substrate was placed in the cylindrical drum of the centrifugal apparatus with the primed anodized aluminum surface facing inward. The edges were joined with Kapton™ tape supplied by DuPont.

Preparation of a Polyurethane Layer:

In a plastic beaker 0.316 grams of an antistat made according to Example 1 of U.S. Pat. No. 5,212,032, incorporated herein by reference; 32.85 grams Voranol™, which is a trimethylol propane base crosslinking agent supplied by Dow Chemical; several drops of SAG 47™, which is a surfactant supplied by Union Carbide; and 615.16 grams L42™, which is a TDI endcapped polyether based resin supplied by Uniroyal, were stirred with a metal spatula. 1.98 Grams EC-300™, which is a diamine chain extender supplied by Ethyl Corp., was added and the mixture was again stirred with a metal spatula for 5 minutes. The residual air was removed from the mixture under reduced pressure (0.01 mmHg). The mixture was poured into the cylindrical drum at room temperature while the mold was spinning at ~500 rpm. After pouring the mixture into the cylindrical drum, the spinning was increased to 1700 rpm, and the temperature was increased to 80° C., and both the temperature and the spinning rate were maintained for sixteen hours.

Preparation of an Overcoat:

The centrifugal apparatus, while still spinning, was allowed to cool to room temperature. In a separate plastic beaker, 31.25 grams toluene and 31.25 grams propyl alcohol were added to 3.0 grams Permuthane™ supplied by Stahl Finish. This solution was poured into the cylindrical drum spinning at 1700 rpm. The cylindrical drum was spun at 1700 rpm for 90 minutes. The mask was removed by cutting the polyurethane along the Kapton™ seam.

Mounting the Mask on a Core:

The mask had a 0.1 inch thick total polyurethane coating. The polyurethane coating was removed from one inch of the two opposite edges of the base. Both edges were perforated with a lithoplate punch. The holes on the edges had 0.15 inch outside diameters and were located 1 inch a part.

The mask was mounted on a core. The core had an approximately 4 inch wide tangential gully running almost the length of the core as shown in FIG. 2. In the gully there were two clamping mechanisms having strips of holes which were bolted to the core through slots in the clamping mechanisms which allowed for slideable movement of the clamping mechanism in relationship to the core. The base was attached to the clamping mechanism by putting screws through the holes in the base and holes in the strips of holes in the clamping mechanisms. One of the clamping mechanisms had springs attached to it and to the core to hold the mask taut around the core.

This roller having the attached mask was tested as an intermediate transfer roller in a laboratory model test copier. The copier produced high image quality copies.

The invention has been described in detail with particular reference to certain preferred embodiments thereof, but it should be understood that variations and modifications can be effected within the spirit and scope of the invention.

PARTS LIST

1 primary image member (photoconductive element)
2 intermediate transfer roller
3 charging station
4 exposure station
5, 6, 7, 8 toner stations
9 gully
10 supply of receiving sheets
11 fuser
12 output tray
13 transport mechanism
14 cleaning station
15 piston
17, 18, 19 rollers
20 polymeric material
21, 22 edges of the base
24 springs
25 transfer station
26 backing roller
27, 28 clamping mechanism
29, 31 bracket holddown slots
30 base
32, 33 strip of holes
36, 37 holes
40 roller mask
50 core

We claim:

1. A roller mask for use as part of a roller in an electrostatographic machine comprising:

a critically dimensionally stable, substantially incompressible base having first and second surfaces and having a Young's Modulus greater than $4.8\times10^4$ MPa and a thermal coefficient of expansion at 100° C. less than 200 μm/m°C., polymeric material adhered to said first surface of said base, said polymeric material having a Young's Modulus greater than 1 MPa and a smooth surface finish of less than 100μ inches, and means for removably mounting said base onto the outside surface of a roller core so that said second surface of said roller mask is next to said outside surface of said roller core.

2. The roller mask of claim 1, wherein said base is cylindrical.

3. The roller mask of claim 1, wherein said base is rectangular.

4. The roller mask of claim 1, wherein said roller mask is an intermediate transfer roller mask.

5. The roller mask of claim 1, wherein said base comprises metal.

6. The roller mask of claim 1, wherein said base comprises a material having a Youngs Modulus greater than $4.8\times10^4$ MPa.

7. The roller mask of claim 1, wherein said base comprises polymeric material.

8. A method of forming the roller mask of claim 1 comprising the steps of:

inserting a critically dimensionally stable base into a centrifugal apparatus;

adding polymeric material to said centrifugal apparatus;

centrifuging until said polymeric material is cast to produce a roller mask; and removing said roller mask from said centrifugal apparatus.

9. A roller for use within an electrostatographic machine comprising:

a core having an outside surface, a mask removably mounted onto said outside surface of said core, said mask comprising a critically dimensionally stable base having first and second surfaces, a polymeric material adhered to said first surface of said base, and means for removably mounting said mask onto said outside surface of said core whereby said second surface of said base is next to said outside surface of said core.

10. The roller of claim 9 wherein said core comprises said means for removably mounting said mask onto said outside surface of said core.

11. The roller of claim 9 wherein said core further comprises a gully and said means for removably mounting said mask onto said core are located in said gully and on said mask.

12. The roller of claim 11 wherein said means for removably mounting said mask onto said core located in said gully comprise clamping mechanisms comprising strips of holes, said means located on said mask comprise holes, and said means for removably mounting said mask onto said core further comprises screws in said holes in said mask and said holes in said clamping mechanism.

13. The roller of claim 9 wherein said polymeric material adhered to said first surface of said base comprises polyurethane.

14. The roller of claim 9 wherein said polymeric material adhered to said first surface of said base comprises fluoroelastomer.

15. The roller of claim 9 wherein said polymeric material adhered to said first surface of said base comprises silicone rubber.

* * * * *